United States Patent [19]

Myers et al.

[11] Patent Number: 4,619,759

[45] Date of Patent: Oct. 28, 1986

[54] TWO-STAGE HYDROTREATING OF A MIXTURE OF RESID AND LIGHT CYCLE OIL

[75] Inventors: John W. Myers; Stephen L. Parrott; Edward L. Sughrue, all of Bartlesville, Okla.

[73] Assignee: Phillips Petroleum Company, Bartlesville, Okla.

[21] Appl. No.: 726,760

[22] Filed: Apr. 24, 1985

[51] Int. Cl.[4] ..... C10G 65/04

[52] U.S. Cl. ..... 208/210; 208/217; 208/251 H; 208/254 H

[58] Field of Search ..... 208/210, 217, 89, 254 H, 208/251 H

[56] References Cited

U.S. PATENT DOCUMENTS

| | | | |
|---|---|---|---|
| 2,429,875 | 10/1947 | Good et al. | 196/14.11 |
| 2,752,287 | 6/1956 | Porter et al. | 196/24 |
| 2,903,413 | 9/1959 | Folkins et al. | 208/57 |
| 3,011,971 | 12/1961 | Slyngstad et al. | 208/210 |
| 3,050,457 | 8/1962 | Wilson | 208/67 |
| 3,168,461 | 2/1965 | Russell et al. | 208/89 |
| 3,179,586 | 4/1965 | Honerkamp | 208/216 |
| 3,184,403 | 5/1965 | Gardner et al. | 208/89 |
| 3,617,501 | 11/1971 | Eng et al. | 208/89 |
| 3,725,251 | 4/1973 | Alpert et al. | 208/210 |
| 3,766,058 | 10/1973 | Hensley, Jr. | 208/210 |
| 3,905,667 | 9/1975 | Murphy, Jr. et al. | 208/210 |
| 3,905,893 | 9/1975 | Christman et al. | 208/210 |
| 3,968,027 | 7/1976 | Frayer et al. | 208/210 |
| 4,021,330 | 5/1977 | Satchell, Jr. | 208/89 |
| 4,048,060 | 9/1977 | Riley | 208/210 |
| 4,116,817 | 9/1978 | Frayer et al. | 208/210 |
| 4,265,731 | 5/1981 | Mitchell | 208/80 |
| 4,302,323 | 11/1981 | Chen | 208/108 |
| 4,306,964 | 12/1981 | Angevine | 208/210 |
| 4,392,945 | 7/1983 | Howard et al. | 208/217 |
| 4,431,525 | 2/1984 | Hensley, Jr. et al. | 208/210 |
| 4,431,526 | 2/1984 | Simpson et al. | 208/210 |

OTHER PUBLICATIONS

"Ketjen Product Data Bulletin", 1982.

Martin, John F., "Cetane Improvement By Hydrotreating" Ketjen Catalyst, 1984.

Advertisement for Ketjenfine ® 840 Catalysts, Hensley et al., "Effects of Catalyst Properties and Process Conditions on the Selectivity of Resid Hydroprocessing", HDS-69, pp. 728-736.

*Primary Examiner*—John Doll

*Assistant Examiner*—Anthony McFarlane

*Attorney, Agent, or Firm*—M. A. Montgomery

[57] ABSTRACT

The catalytic hydrotreatment of a mixture comprising a resid and a light cycle oil is carried out in a multiple catalyst bed in which the portion of the catalyst bed with which the feedstock is first contacted contains a catalyst which comprises of alumina, cobalt and molybdenum and the second portion of the catalyst bed through which the feedstock is passed after passing through the first portion contains a catalyst comprising alumina to which molybdenum and nickel have been added.

12 Claims, 1 Drawing Figure

TWO-STAGE HYDROTREATING OF A MIXTURE OF RESID AND LIGHT CYCLE OIL

BACKGROUND OF THE INVENTION

This invention relates to hydrotreating of hydrocarbon streams. In particular it relates to catalytic hydrotreating. It also relates to the treating of residual oils and light cycle oil.

The increased demand for premium fuels, such as gasoline, diesel fuel, jet fuel, etc., coupled with the diminishing reserves of high-grade, sweet crude oils has dictated that the petroleum industry use greater proportions of heavier, lower quality, higher-sulfur containing crude oils in their operations in order to meet the needs of consumers. In addition to increased amounts of sulfur, many of the readily available crudes also contain increased quantities of metal compounds, nitrogen compounds and polycyclic hydrocarbons, such as asphaltenes. The undesirable components are generally found in the higher boiling components of the crudes and, hence, tend to become concentrated during distillation of the crude in the higher boiling fractions, particularly the bottoms fractions. These bottoms, unvaporized liquids remaining after distillation at atmospheric pressure or under vacuum, are generally called "residual stocks" or simply "resids." It is desirable to subject such resids to conditions of hydrodesulfurization, hydrodenitrogenation and/or hydrodemetallization prior to further processing, such as cracking, in order to convert the resids into higher valued products.

Hydrodesulfurization is a process intended primarily to convert the sulfur in organic sulfur compounds to hydrogen sulfide. Hydrodenitrogenation is a process intended primarily to convert the nitrogen in organic nitrogen compounds to ammonia. Hydrodesulfurization and hydrodenitrogenation will generally occur at the same time under similar process conditions if both organic sulfur compounds and organic nitrogen compounds are present in the feed stream. The hydrogen sulfide and/or ammonia can be removed from the feed stream after the hydrodesulfurization and/or hydrodenitrogenation process. Hydrodesulfurization and hydrodenitrogenation are processes which are typically utilized to remove sulfur and nitrogen from a hydrocarbon-containing feedstock which also contains organic sulfur compounds and/or organic nitrogen compounds to produce fuels which, when burned, will meet environmental standards. The processes can be applied to feed streams other than hydrocarbon-containing feeds if organic sulfur compounds and/or organic nitrogen compounds are present and the removal of sulfur and/or nitrogen is desired.

The earliest hydrodesulfurization and/or hydrodenitrogenation catalysts were bauxite and Fuller's earth. Later, catalysts containing cobalt oxide plus molybdenum oxide on alumina and nickel oxide plus tungsten oxide on alumina substantially replaced the earlier catalyst and these catalysts are still used very extensively. Another effective catalyst is a catalyst composition comprising cobalt, molybdenum, zinc, titanium and catalytic grade alumina disclosed in U.S. Pat. No. 4,287,050.

Hydrodemetallization is a process intended primarily to remove metals from a feed stream. Metals, such as vanadium and nickel, make further processing of the heavy fractions difficult since the metals generally act as poisons for catalysts employed in processes such as catalytic cracking. Hydrodemetallization has been accomplished in the past using a wide variety of catalysts under conditions of temperature and pressure and in the presence of hydrogen to selectively deposit the metals or metal-containing compounds on the surface of the catalyst. Hydrodemetallization is sometimes unintentially and undesirably accomplished, e.g., in hydrodesulfurization where the metals in the feed are deposited on the hydrodesulfurization catalyst resulting in deactivation and poisoning of the catalyst.

In the hydrotreating and hydrocracking of resids, benefit has been realized by mixing with the heavy residual stock a substantial portion of a light cycle oil (see, for example, U.S. Pat. No. 4,302,323). Light cycle oil is a distillate fraction boiling in the range of 400°–650° F. which contains high amounts of unsaturated compounds, generally polycyclic aromatic compounds. It is a lower valued product, especially because it is a poor blending stock for diesel fuel. In addition to a reduced cetane index, the light cycle oil imparts lower oxidative stability to any diesel fuel composition with which it is blended. Thus it is desirable to subject such fractions to conditions of hydrogenation which will at least partially saturate the aromatic rings in the polycyclic aromatic components of the fractions and thereby improve their value.

It is desirable to subject a mixture of resid and light cycle oil to conditions of hydrodemetallization, hydrogenation, hydrodesulfurization, and/or hydrodenitrogenation because in such a process the resid is converted to products of higher value for further downstream processing and the light cycle oil is converted to products of lower aromatic unsaturation for further downstream processing or for use directly in consumer products, e.g., blending with various motor fuels.

It is thus an object of this invention to provide a process for the hydrodemetallization, hydrogenation, hydrodesulfurization and/or hydrodenitrogenation of a mixture of resid and light cycle oil which exhibits higher activity and better selectivity than processes previously used.

Another object of this invention is to protect downstream catalyst from being poisoned.

Other objects and advantages of the invention will be apparent from the foregoing brief description of the invention and the appended claims, as well as the detailed description of the invention which follows.

SUMMARY OF THE INVENTION

We have now found an arrangement of hydrotreating catalysts (in the substantial absence of catalysts primarily designed for hydrocracking) that effectively and simultaneously upgrades both a resid and a light cycle oil.

In accordance with the present invention, a multiple (preferably dual) catalyst bed comprising a first catalyst composition and a second catalyst composition is utilized in a hydrotreating (hydrodemetallization, hydrogenation, hydrodesulfurization and/or hydrodenitrogenation) process. The portion of the multiple catalyst bed with which the feed stream, comprising a mixture of at least one resid and at least one cycle oil, is first contacted contains at least one first catalyst composition comprising alumina, promoted with a relatively low amount of molybdenum and cobalt and optionally titanium and/or nickel. The last one or more portions of the multiple catalyst bed (referred to hereinafter as second catalyst composition) through which the feed stream is passed after passing through the first catalyst composition contains a catalyst composition comprising alumina to which a relatively large amount of molybdenum and nickel have been added. The total amount of nickel plus molybdenum of the second composition exceeds the total amount of cobalt plus molybdenum in the first catalyst composition. The hydrotreating process is carried out under suitable conditions to result in substantial activity for hydrodemetallization, hydrogenation, hydrodesulfurization and/or hydrodenitrogenation.

Any suitable organic sulfur compound contained in a hydrocarbon-containing feedstock can be hydrodesulfurized in accordance with the present invention. Suitable organic sulfur compounds include sulfides, disulfides, mercaptans, thiophenes, benzothiophenes, dibenzothiophenes and mixtures thereof.

Any suitable organic nitrogen compound contained in a hydrocarbon-containing feedstock can be hydrodenitrogenated in accordance with the present invention. Suitable organic nitrogen compounds include amines, diamines, pyridines, pyrroles, quinolines, porphyrins, benzoquinolines and mixtures thereof.

The catalyst composition which is employed in the *first catalyst bed* is at least one conventional hydrodesulfurization and/or hydrodenitrogenation catalyst which comprises alumina and metal promoters. The metallic components, cobalt and molybdenum and, optionally, titanium and/or nickel will typically but not necessarily be present in the oxide form. The concentration of cobalt as an oxide (preferably CoO) is typically in the range of about 0.5 weight percent to about 10 weight percent cobalt oxide based on the weight of the total catalyst composition. The concentration of molybdenum as an oxide (preferably $MoO_3$) is generally in the range of about 2 weight percent to about 25 weight percent molybdenum oxide based on the weight of the total catalyst composition. The concentration of titanium as an oxide ($TiO_2$) and/or nickel oxide (NiO) in the catalyst will generally range from 0 to about 10 weight percent based on the weight of the total catalyst composition. Pertinent properties of three commercial catalysts are set forth in Table I.

TABLE I

| Catalyst | CoO (Wt. %) | $MoO_3$ (Wt. %) | Bulk Density* (g/cc) | Surface Area ($m^2/g$) |
|---|---|---|---|---|
| Shell 344 | 2.99 | 14.42 | 0.79 | 186 |
| Katalco 477 | 3.3 | 14.0 | .64 | 236 |
| KF - 165 | 4.6 | 13.9 | .76 | 274 |

*measured on 20/40 mesh particles, compacted.

The catalyst employed in the *second catalyst bed* is at least one calcined composition comprising catalytic grade alumina to which molybdenum and nickel have been added. The molybdenum and nickel are generally present in the oxide form NiO and $MoO_3$. The concentration of nickel as an oxide in this catalyst is preferably in the range of from about 2 weight percent to about 12 weight percent nickel oxide and will more preferably be in the range from about 3 weight percent to about 8 weight percent nickel oxide. The concentration of molybdenum as an oxide is preferably from about 15 weight percent to about 35 weight percent molybdenum oxide and more preferably from about 17 weight percent to 30 weight percent molybdenum oxide based on the weight of the total catalyst composition.

The multiple catalyst bed of this invention can contain one or more first catalysts, which can be the same or different, and one or more second catalysts, which can be the same or different. Preferably, a dual bed is used with one first catalyst composition and one second catalyst composition.

Any catalytic grade alumina known in the art can be utilized including the forms of catalytic grade alumina known as eta- or gamma-alumina.

Either the elemental form of the metallic catalyst components or any suitable compound thereof can be used to form the catalyst composition.

Nickel or cobalt compounds suitable for use are the nitrate, sulfate, carbonate, oxalate, oxide, and mixtures of two or more thereof.

Molybdenum compounds suitable for use are ammonium molybdate, ammonium heptamolybdate, sodium molybdate, potassium molybdate, molybdenum oxides such as molybdenum (IV) oxide and molybdenum (VI) oxide and the like and mixtures of two or more thereof.

Titanium compounds suitable for use are titanium esters and citrates and the like.

The two catalyst components can be prepared by any method known in the art. The nickel or cobalt and molybdenum can be added individually or simultaneously by impregnating the alumina with a solution—aqueous or organic—of a soluble compound of the metal. The catalytic grade alumina can be 1/32" or larger extrudate, preferably about 1/16" extrudate, although this is not required. After the metallic components have been added to the catalytic grade alumina, the catalyst composition is washed to remove, e.g., sulfates or halides before proceeding to the drying step. After drying to remove essentially all the solvent, a solution of another metallic component is added by impregnation if all metallic components were not added in the first impregnation step. The sequence in which the metallic components are added is immaterial. After all of the metallic components have been added, the catalyst composition is calcined in the presence of oxygen at a temperature in the range of about 500° C. to about 650° C. until volatile matter is removed and the metallic components are substantially converted to their oxides. The time required for the calcining step may range from about 0.1 to about 10 hours. The surface area (measured by BET/$N_2$) of the first and second catalyst will generally be at least 50 $m^2/g$, preferably in the range of about 100 to about 300 $m^2/g$. The pore volume (measured by mercury porosimetry) of the first and second catalyst will generally range from about 0.2 to about 2.5 mL/g, preferably from about 0.3 to about 1.5 mL/g.

The catalysts are preferably presulfided before use or can be sulfided during the hydrodesulfurization process. In the refinery, presulfiding is generally done by using gas oil feeds often spiked with sulfur compounds along with hydrogen. On the other hand, in laboratory work presulfiding is usually accomplished by using a gas mixture of $H_2$ and $H_2S$.

In the scope of this invention, any hydrocarbon-containing feedstock can be treated with the dual catalyst bed system of this invention. However, this invention is particularly suitable for hydrocarbon-containing feedstocks comprising (a) a resid containing high levels of sulfur compounds, nitrogen compounds and metal compounds and (b) a light cycle oil containing substantial amounts of aromatics.

Any mixture of resids and light cycle oil can be used in the preferred embodiment of this invention. In general the amounts of light cycle oil in said mixture will range from about 5 to about 30 weight percent.

Typical light cycle oils useful in this invention are produced as a product stream in the catalytic cracking of crude oil or fractions thereof. Generally the boiling range (ASTM distillation at atmospheric pressure) of the light cycle oil is about 400° F. to about 650° F. The cetane index (ASTM 976) generally ranges from about 15 to about 50, particularly about 20 to about 40. The API gravity generally ranges from about 12 to about 35, particularly about 15 to about 30. The aromatics content generally ranges from about 30 to about 80 percent by volume. The sulfur content generally ranges from about 0.5 to about 2 weight percent.

Typical resids useful in this invention are heavy petroleum fractions produced in atmospheric or vacuum distillation operations. These resids generally have an initial boiling point (at atmospheric pressure) of at least about 600° F., particularly at least about 650° F. Some resids such as those produced by vacuum distillation can have an initial boiling point of about 750° F. Generally these resids contain about 10–1000 ppmw, particularly about 25–200 ppmw, of nickel plus vanadium; about 0.5–5 weight percent, particularly about 1–4 weight percent of sulfur and about 0.05–2 weight percent, particularly 0.2–1 weight percent, of total nitrogen. Generally the API gravity ranges from about 8 to about 30 particularly from about 10 to about 20.

The process of this invention can be carried out by means of any apparatus whereby there is achieved a contact with the catalysts and the mixture of resid and light cycle oil to be hydrotreated. The process is in no way limited to the use of a particular apparatus. The process of this invention can be carried out using a fixed catalyst bed, fluidized catalyst bed, or moving catalyst bed. Presently preferred is a fixed catalyst bed.

Two or more catalyst beds can be in physical contact or can be separated. In general, it is not necessary to add anything to or take anything from the process stream flowing from the first catalyst bed to the second catalyst bed. The present invention is described in terms of using one reactor containing both catalyst beds but the invention is applicable to using two or more separate reactors. In the preferred embodiment, there is no treatment or separation of the feedstream between the first catalyst bed and the second catalyst bed.

Any suitable temperature for hydrotreatment of the mixture of resid and light cycle oil in the reactor can be utilized. The temperature will generally be in a range of about 200° C. to about 550° C. and will more preferably be in the range of about 300° C. to about 450° C. for the hydrodemetallization, hydrogenation, hydrodesulfurization process, and/or the hydrodenitrogenation process.

To maintain the activity of the catalysts, the temperature of the hydrotreatment process is gradually increased to compensate for loss of catalyst activity due to fouling of the catalysts.

Any suitable pressure for the hydrotreatment of the mixture of resid and light cycle oil in the reactor can be utilized, such as pressure of up to 5000 psia. In general, the pressure will be in the range of about 200 to about 3000 psia total system pressure. The total system pressure is the sum of the partial pressure of the feedstock plus the partial pressure of the added hydrogen. Preferably, the total system pressure will be in the range of from about 1,500 to about 2,500 psia.

Any suitable quantity of hydrogen can be added to the hydrotreatment process. The quantity of hydrogen used to contact the feedstock will be in the range from about 100 to about 10,000 SCF/bbl and will more preferably be in the range from about 500 to about 3000 SCF/bbl.

Any suitable residence time for the feedstock in the reactor can be utilized. In general, the residence time is expressed in terms of the liquid hourly space velocity (volumes of liquid per total volume of the first and second catalyst compositions per hour). The liquid hourly space velocity (LHSV) can range from about 0.1 to about 20 and will more preferably range from about 1 to about 5 for both the hydrotreatment process.

Figure 1:
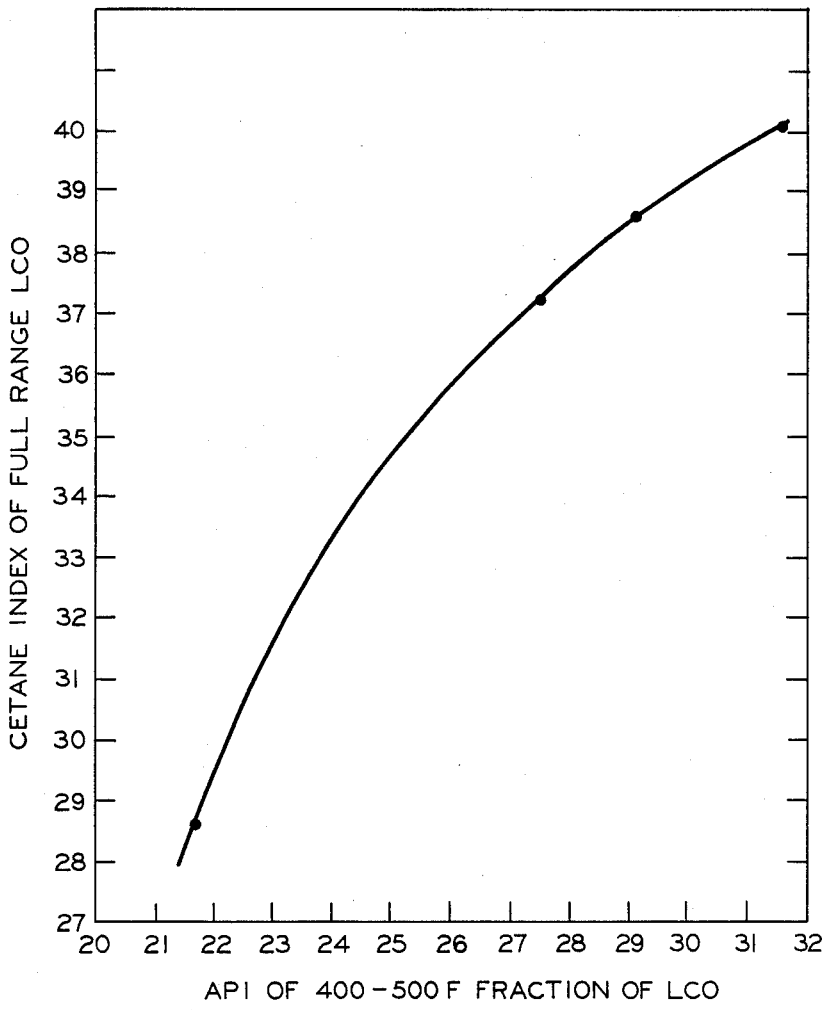
FIG. 1 is a graph that shows the effects of hydrotreating light cycle oil (LCO). In this graph the data point with the 29 cetane index represents the unhydrotreated LCO and the three data points with higher cetane index are hydrotreated LCO. This figure shows the strong correlation of cetane index and API gravity of the 400–500 F. boiling fraction. Thus for this LCO the API gravity of the 400–500 F. fraction can be used to estimate the cetane index of the total hydrotreated LCO.

The following examples are presented in further illustration of the invention.

EXAMPLE I

In two comparative runs, either a mixture of 85 weight percent Arabian light atmospheric resid and 15 weight percent light cycle oil (LCO) or resid alone (see Tables I and II for feed properties) was passed through a ¾" I.D., 22" long reactor packed with a mixture of 70 cc of catalyst A (properties in Table III) and 70 cc alundum at 396° C. (745° F.), 2250 psig, and 3500 scf/B hydrogen. For both control runs, the LHSV of the resid component was 0.35; thus when LCO was mixed with the resid the overall LHSV was 0.42.

The catalyst was presulfided by passing a mixture of 10% $H_2S$ in $H_2$ over the catalyst first at 400° F., then at 700° F. The treatment time at each temperature was sufficient to pass several times the amount of $H_2S$ which would be required to completely sulfide the catalyst if it all reacted.

TABLE I

| Properties of Arabian Light 650° F. + Resid | |
|---|---|
| Gravity, API | 16.6 |
| Sulfur, wt. % | 2.96 |
| Ramsbottom Carbon Residue, wt. % | 7.9 |
| Nickel, ppm | 12.1 |
| Vanadium, ppm | 41.6 |

TABLE II

| Properties of Light Cycle Oil Distillation Data | |
|---|---|
| Fraction, °F. | Vol. % |
| IBP-400 | 1.7 |
| 400–500 | 28.8 |
| 500+ | 69.5 |
| Gravity, API | 20.2 |
| Cetane Index (1980) | 28.6 |
| Sulfur, wt. % | 1.4 |

TABLE III

| | Catalyst Properties | |
|---|---|---|
| | Catalyst A | Catalyst B |
| $MoO_3$, wt. % | 12 | 27 |
| CoO, wt. % | 4 | 0 |
| NiO, wt. % | 0 | 6.7 |
| $Al_2O_3$ | Remainder | Remainder |
| Surface area[1], $m^2$/gm | 280 | 220 |
| Pore volume[2], ml/gm | 0.47 | 0.39 |
| Avg. pore diameter[3], A | 67 | 70 |

[1]Measured by the BET method with $N_2$ gas
[2]Measured by mercury porosimetry at 50 Kpsi Hg
[3]Calculated from pore volume (PV) and surface area (SA): 4PV/SA Reactor effluents of the two runs were collected and fractionated at atmospheric pressure. Amounts and pertinent properties of the various boiling point fractions are summarized in Tables IV and V.

TABLE IV

| | Treated Resid | | | |
|---|---|---|---|---|
| Fraction | Density (g/cc) | API Gravity | Weight % | Volume % |
| IBP-400° F. | 0.7655 | 53.2 | 4.33 | 5.1 |
| 400-500° F. | 0.8466 | 35.5 | 3.16 | 3.4 |
| 500-650° F. | 0.8887 | 27.6 | 8.92 | 9.1 |
| 650° F.+ | 0.9162 | 22.8 | 83.59 | 82.4 |

TABLE V

| | Treated Mixture of Resid + LCO | | | |
|---|---|---|---|---|
| Fraction | Density (g/cc) | API Gravity | Weight % | Volume % |
| IBP-400° F. | 0.7822 | 49.2 | 4.73 | 5.4 |
| 400-500° F. | 0.8821 | 28.8 | 9.50 | 9.7 |
| 500-650° F. | 0.8820 | 28.8 | 14.08 | 14.4 |
| 650° F.+ | 0.9150 | 23.0 | 71.69 | 70.5 |

In order to obtain the composition and gravity of the LCO product in the treated mixture, which initially contained 15 weight-% LCO and 85 weight-% resid, the following calculations were carried out. The weight-% of each fraction of the treated resid was multiplied by 0.85, and this product was subtracted from the weight-% of the corresponding fraction of the treated mixture. The following LCO weight percentages in the treated mixture were calculated:

IBP-400° F.: $4.73-0.85\times4.33=1.05$ wt-%

400°-500° F.: $9.50-0.85\times3.16=6.81$ wt-%

500°-650° F.: $14.08-0.85\times8.92=6.50$ wt-%

650° F.+: $71.69-0.85\times83.59=0.64$ wt-%

The calculation of LCO product densities is based on the assumption that the volume-% of the treated mixture was equal to the sum of the volume-% of treated LCO and 0.85×volume-% of the treated resid. The volume percentages were calculated by dividing the weight-% of a particular fraction by its density. The fraction of particular interest is the 400°-500° F. fraction because it best represented the full range LCO that had the least interference from the resid. The following equation could be written for this fraction.

$$\frac{9.50}{0.8821}=\frac{6.81}{X}+\frac{0.85\times3.16}{0.8466}$$

where X is the density of the 400°-500° F. LCO fraction. The solution of this equation resulted in X=0.896 g/cc, which corresponds to API=26.1.

An empirical correlation of the API gravity of the 400°-500° F. LCO fraction and the cetane index of the entire LCO, established by the inventors and shown in FIG. 1, was used to determine the cetane index of the full range LCO product in the mixture. A cetane index of 35.9 was found. This was an improvement of 35.9−28.6=7.3 over the cetane index of the untreated LCO (See Table II).

EXAMPLE II

Two runs employing the catalyst system of this invention were conducted as described in Example I, except that the top half of the catalyst bed was filled with a mixture of 35 cc of Catalyst A and 35 cc of alundum, and the bottom half was packed with a mixture of 35 cc of Catalyst B (see Table III) and 35 cc of alundum. Both catalysts were presulfided as outlined in Example I. Reactor effluent compositions and properties are summarized in Tables VI and VII.

TABLE VI

| | Treated Resid | | | |
|---|---|---|---|---|
| Fraction | Density (g/cc) | API Gravity | Weight % | Volume % |
| IBP-400° F. | 0.7845 | 48.7 | 2.90 | 3.3 |
| 400-500° F. | 0.8540 | 34.0 | 2.70 | 2.8 |
| 500-650° F. | 0.8738 | 30.3 | 13.73 | 14.1 |
| 650° F.+ | 0.9073 | 24.3 | 80.66 | 79.8 |

TABLE VII

| | Treated Mixture of Resid + LCO | | | |
|---|---|---|---|---|
| Fraction | Density (g/cc) | API Gravity | Weight % | Volume % |
| IBP-400° F. | 0.7925 | 46.9 | 3.71 | 4.2 |
| 400-500° F. | 0.8767 | 29.8 | 9.17 | 9.4 |
| 500-650° F. | 0.8711 | 30.8 | 17.07 | 17.5 |
| 650° F.+ | 0.9072 | 24.3 | 70.04 | 69.0 |

Results of calculations of LCO weight percentages and API gravities, in accordance with the procedures outlined in Example I, are:

IBP-400° F.: $3.71-0.85\times2.90=1.24$ wt-%

400°-500° F.: $9.17-0.85\times2.70=6.87$ wt-%

500°-650° F.: $17.07-0.85\times13.73=5.40$ wt-%

650° F.+: $70.04-0.85\times80.66=1.48$ wt-%;

density and API gravity of the 400°-500° F. fraction were 0.884 g/cc and 28.3, respectively. The cetane index of the treated LCO, as determined from the graphic correlation shown in FIG. 1, was 37.9. This was an improvement of 37.9−28.6=9.3 over the cetane index of the untreated LCO.

Thus, unexpectedly, a greater cetane index improvement of LCO (9.3 vs. 7.3) was attained in the invention process of this example employing a dual catalyst bed vs. the control process of Example I employing a single catalyst bed.

We claim:

1. A process for the catalytic hydrotreating of a feed stream comprising a mixture of a resid and a light cycle oil comprising the steps of:

contacting said feedstream in the absence of a catalyst primarily designed for hydrocracking under suitable hydrotreating conditions with at least one first catalyst composition which comprises alumina and an amount of cobalt and molybdenum that promotes hydrotreating; and then contacting said thus treated feedstream under suitable hydrotreating conditions with at least one second catalyst composition comprising alumina and an amount of molybdenum and nickel that promotes hydrotreating wherein the total amount of nickel plus molybdenum of the at least one second catalyst composition exceeds the total amount of cobalt plus molybdenum of the at least one first catalyst composition thereby producing a product stream having an improved cetane index.

2. A process in accordance with claim 1 wherein the concentration of cobalt as an oxide in said first catalyst composition is in the range of about 0.5 weight percent to about 10 weight percent cobalt oxide based on the total weight of said first catalyst composition, and wherein the concentration of molybdenum as an oxide in said first catalyst composition is in the range of about 2 weight percent to about 25 weight percent molybdenum oxide based on the total weight of said first catalyst composition.

3. A process in accordance with claim 1 wherein the concentration of nickel as an oxide in the second catalyst composition is in the range of about 2 weight to about 12 weight percent nickel oxide based on the total weight of said second catalyst composition and wherein the concentration of molybdenum as an oxide in said second catalyst composition is in the range of about 15 weight percent to about 35 weight percent molybdenum oxide based on the weight of the second catalyst composition.

4. A process according to claim 2 where said molybdenum oxide is $MoO_3$.

5. A process according to claim 2 where said cobalt oxide is CoO.

6. A process according to claim 3 where said nickel oxide is NiO.

7. A process according to claim 3 where said molybdenum oxide is $MoO_3$.

8. A process in accordance with claim 1 wherein said first and second catalyst composition are contacted with said mixture of resid and light cycle oil under suitable hydrotreating conditions which comprise a temperature in the range of about 200° C. to about 550° C., a total system pressure in the range of 200 psia to about 3000 psia, a hydrogen flow rate in the range of about 100 to about 10,000 SCF/bbl and a liquid hourly space velocity for said fluid feed stream in the range of about 0.1 to about 20 liquid volumes of said fluid feed stream per total volume of said first and second catalyst compositions per hour.

9. A process in accordance with claim 8 wherein said first and second catalyst composition are contacted with said mixture of resid and light cycle oil under suitable hydrotreating conditions which comprise a temperature in the range of about 300° C. to about 450° C., a total system pressure in the range of 1,500 psia to about 2,500 psia, a hydrogen flow rate through said reactor in the range of about 500 to about 3000 SCF/bbl and a liquid hourly space velocity for said fluid feed stream in said reactor in the range of about 1 to about 5 liquid volumes of said fluid feed stream per total volume of said first and second catalyst compositions per hour.

10. A process in accordance with claim 1 wherein said first and second catalyst compositions are sulfided prior to the steps of contacting said mixture with said first and second catalyst compositions.

11. A process according to claim 1 where said mixture comprises from about 5 weight percent to about 30 weight percent of light cycle oil, based on the weight of said feedstream.

12. A process according to claim 1 where said first catalyst composition is in a first catalyst bed and said second catalyst composition is in a second catalyst bed and said first and second catalyst beds are in a single reactor.

* * * * *